United States Patent [19]

Sorenson et al.

[11] 4,239,148

[45] Dec. 16, 1980

[54] STORAGE BOX

[75] Inventors: John F. Sorenson, St. Paul; Frank W. Locke, Minneapolis, both of Minn.

[73] Assignee: Champion International Corporation, Stamford, Conn.

[21] Appl. No.: 55,906

[22] Filed: Jul. 9, 1979

[51] Int. Cl.[3] .....B65D 5/30; B65D 5/22; B65D 5/24

[52] U.S. Cl. ..... 229/36; 229/45 R

[58] Field of Search.....229/33, 34, 229/36, 44, 45

[56] References Cited

U.S. PATENT DOCUMENTS

| | | | |
|---|---|---|---|
| 1,600,260 | 9/1926 | Walter | 229/36 |
| 2,355,578 | 8/1944 | Williams et al. | 229/45 |
| 2,357,155 | 8/1944 | Williams et al. | 229/45 X |
| 2,366,304 | 1/1945 | Williams et al. | 229/45 X |
| 2,731,191 | 1/1956 | Layne et al. | 229/45 X |
| 3,933,300 | 1/1976 | Dempster | 229/36 X |
| 4,046,309 | 9/1977 | Poggiali | 229/31 FS X |
| 4,082,215 | 4/1978 | Eichemauer | 229/36 |

*Primary Examiner*—Davis T. Moorhead
*Attorney, Agent, or Firm*—Evelyn M. Sommer

[57] ABSTRACT

A box for storing files is formed from a single blank of paperboard. The blank consists of a centrally located bottom wall panel having side wall panels foldably connected thereto. Each of the centrally located bottom walls panels and side wall panels have an end wall panel extending from a transverse edge thereof so that when the side wall panels are folded 90° relative to the bottom wall panel, the end wall panels on the transverse edges of the side walls and bottom walls can be overlapped and locked together. Connected to the outer longitudinal edges of each of the side wall panels is a top wall panel substantially half the width of the centrally located bottom panel. The top wall panels are adapted to be folded 90° relative to the side walls to form a cover for the box. Longitudinally extending tabs extend from the transverse edges of each of the top wall panels and can be inserted within an opening in the end walls to lock the top wall panels in place on the box.

9 Claims, 10 Drawing Figures

Fig. 1.
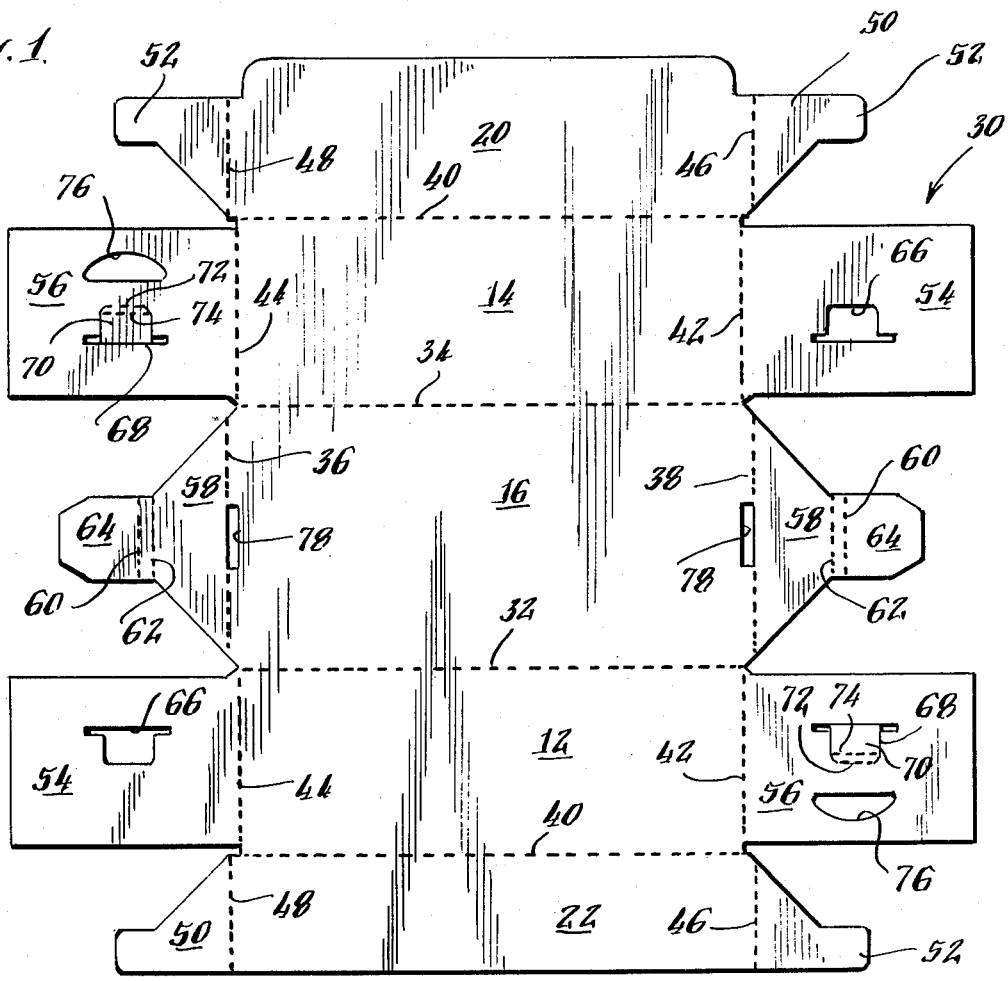
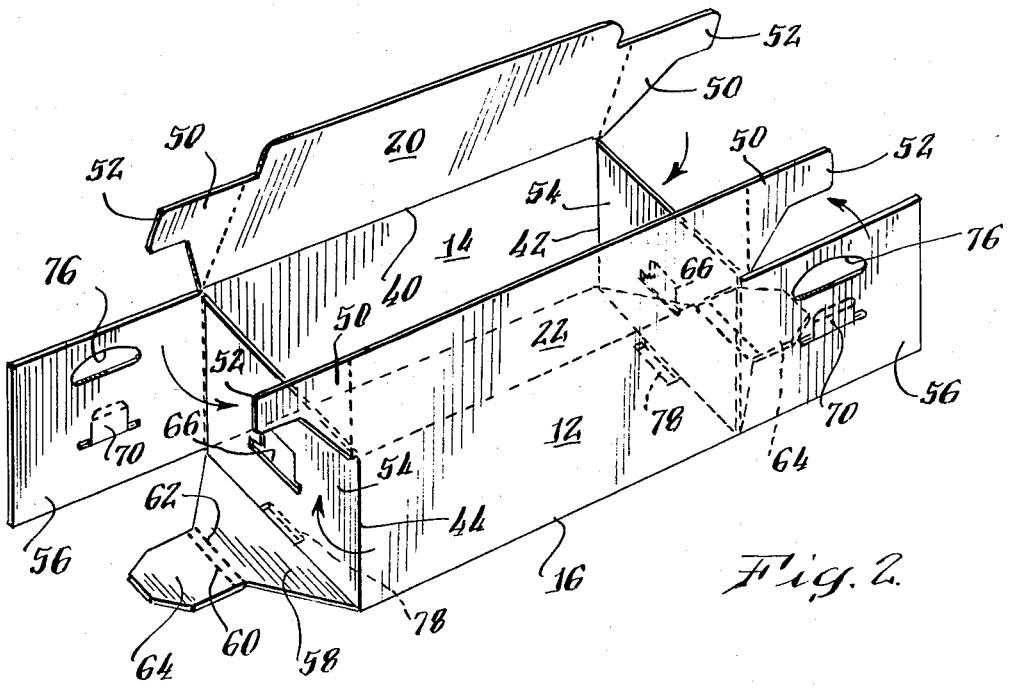
Fig. 2.

STORAGE BOX

BACKGROUND AND SUMMARY OF THE INVENTION

This invention relates to a box construction, and more particularly, a box construction adapted for use in the storage of files and documents.

Heretofore, file storage boxes were cumbersome and were usually formed from two parts; a bottom which retained the files and documents and a separate cover for enclosing the documents so they can be stored within the box. The box had to be formed from strong materials such as steel or corrugated paperboard in order to hold the heavy weight of the stored files. This essentially precluded the box construction from being made from a single blank of foldable paperboard material as the requisite strength could not be attained.

The present invention, however, provides a storage file box which can be quickly assembled from one-piece of paperboard material. The result is a box construction which has the requisite strength for holding heavy contents such as files and other papers is quickly and easily assembled and can be shipped in a flat or knocked down condition. The one-piece bland also precludes the necessity of supplying a separable cover element as the cover is formed integral with the bottom and side end wall-forming portions of the one-piece blank.

In accordance with the invention, a box for storing files is formed from a single blank of paperboard. The blank consists of a centrally located bottom wall panel having side wall panels foldably connected thereto. Each of the centrally located bottom wall panels and side wall panels have an end wall panel extending from a transverse edge thereof so that when the side wall panels are folded 90° relative to the bottom wall panel, the end wall panels on the transverse edges of the side walls and bottom walls can be overlapped and locked together. Connected to the outer longitudinal edges of each of the side wall panels is a top wall panel substantially half the width of the centrally located bottom panel. The top wall panels are adapted to the folded 90° relative to the side walls to form a cover for the box. Longitudinally extending tabs extend from the transverse edges of each of the top wall panels and can be inserted within an opening in the end walls to lock the top wall panels in place on the box.

The means for locking the end wall panels together include registerable openings in a pair of overlapping end wall panels connected to the upper and lower transverse edges respectively, of the side walls of the box. A third overlapping end wall panel is connected to the transverse edge of the central, bottom wall panel. The third end wall includes an elongated tab which is insertable through the registered openings in the overlapping end wall panels connected to the side walls and bendable 180° and received in an opening formed in the bottom wall panel. This locking arrangement provides for a three-ply end wall construction, which reinforces the box, and provides for the walls to be retained together in a simple and effective manner.

The locking tabs for the top wall panels are inserted within a separate opening formed on the outermost one of each of the overlapping pair of end panels.

BRIEF DESCRIPTION OF THE DRAWINGS

Further objects and advantages of the invention will become apparent from the following descriptions and claims, and from the accompanying drawings, wherein:

FIG. 1 is a top plan view of a blank used to form the storage box construction of the present invention;

FIGS. 2 through 6 are perspective views illustrating the folding of the blank of FIG. 1 to form the storage box construction of the present invention;

DETAILED DESCRIPTION OF THE PREFERRED EMBODIMENT

Figure 6:
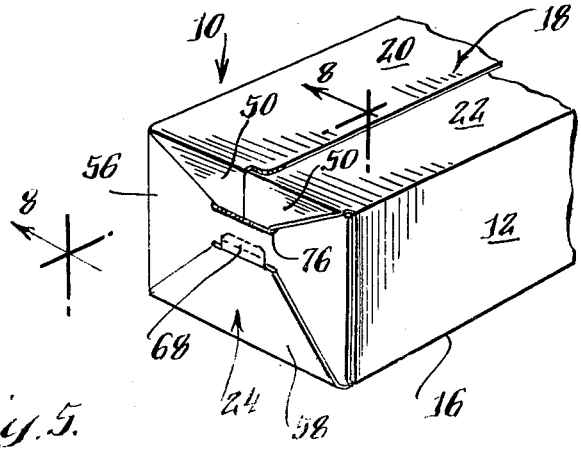
Figure 8:
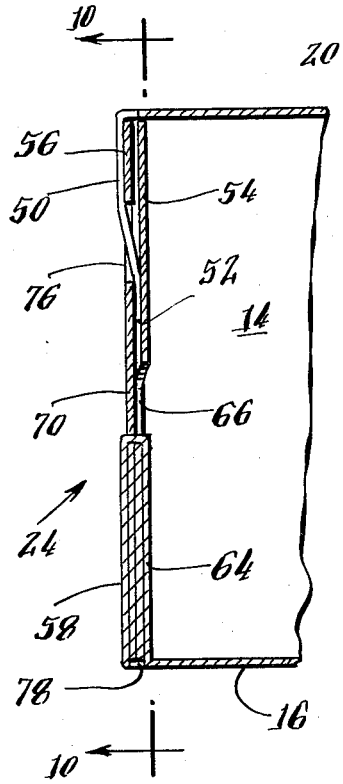
FIG. 8 is a cross-sectional view similar to FIG. 7 taken substantially along the plane indicated by line 8—8 of FIG. 6, illustrating the end panels of the box construction partially locked together.
Figure 9:
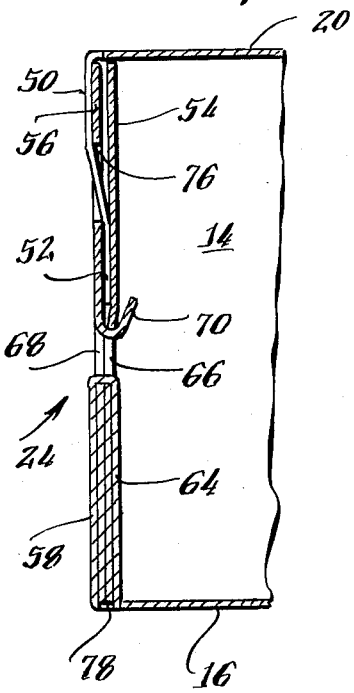
FIG. 9 is a cross-sectional view similar to FIG. 8, but with the end panels of the box construction completely locked together.
Figure 10:
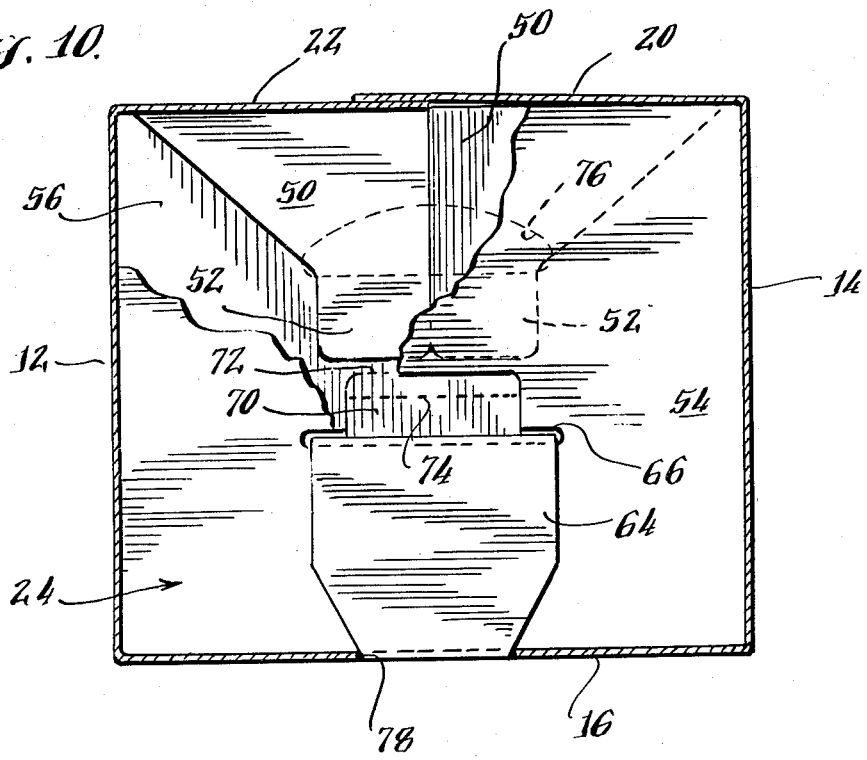
FIG. 10 is a cross-sectional view of the box construction taken substantially along the plane indicated by line 10—10 of FIG. 8.

Referring now in detail to the drawings wherein like numerals indicate like elements throughout the several views, the file storage box of the present invention is indicated in FIG. 6 by the numeral 10.

The box 10 includes a pair of opposed side walls 12 and 14, a bottom wall 16, and a top wall 18 formed from a pair of panels 20 and 22. Opposed end walls 24 and 26 between the side walls and the bottom and top wall complete the construction. Each end wall 24 and 26 is of a three-ply construction for maximum strength while the cover panels 20 and 22 are formed integral with the side walls 14 and 12, respectively, thereby precluding the necessity of providing a separate cover element for the box 10.

The storage box 10 is formed from a planar, one-piece paperboard blank 30, illustrated in FIG. 1.

The blank 30 includes a centrally located bottom wall forming panel 16 having opposed, longitudinal edges 32 and 34 and opposed transverse edges 36 and 38. Foldably connected to longitudinal edge 34 of panel 16 is the side wall forming panel 14. Foldably connected to the longitudinal edge 32 of panel 16 is the side wall forming panel 12.

Each of the side wall forming panels 12 and 14 include longitudinal edges 40 parallel to longitudinal edge 32 (in the case of panel 12) and longitudinal edge 34 (in the case of panel 14). The panels 12 and 14 also include parallel, transverse edges 42 and 44.

Foldably connected to the longitudinal edge 40 of panel 12 is the top forming panel 22. Similarly, foldably connected to edge 40 of panel 14 is the top forming panel 20. Panels 20 and 22 are substantially one half the width of centrally located bottom panel 16 of blank 30, except that panel 20 is slightly wider for the purpose which will become apparent hereinafter.

Each of the top-forming panels 20 and 22 include opposed, parallel transverse edges 46 and 48. A longitudinally extending tab 50, basically in the shape of a right triangle projects outwardly from the edges 46 and 48 of the panels 20 and 22, respectively. The elongated tab 50 ends in a substantially rectangular tongue portion 52.

Connected to the transverse edges 44 of side panels 12 and 14 are rectangular end panels 54 and 56, respectively. Similarly, an identical end panel 56 is foldably connected to transverse edge 42 of side panel 12, while a rectangular end panel 54 is foldably connected to transverse edge 42 of side panel 14. As will be described hereinafter, end panels 54 and 56 are adapted to overlap each other during the construction of box 10 to form two plies of each end wall 24, 26 of box 10. A third ply is provided by a trapezoidal shaped panel 58 foldably connected to bottom panel 16 along transverse edges 36 and 38. Connected to the top edge of trapezoidal panel 58 by spaced foldlines 60 and 62 is a elongated tab 64 used to lock each of the three-ply end walls 24, 26 of box 10 together after erection.

Each end panel 54 is provided with a bell-shaped opening 66. End panels 56 also include a bell-shaped opening 68 covered by a die cut tab 70 connected to the top edge of opening 68 by a foldline 72. A second foldline 74 is provided intermediate the edges of die-cut tab 70.

A second, half-moon shaped opening 76 is also provided on each end panel 56. Rectangular openings 78 formed on bottom panel 16 along the transverse edges 36 and 38 intermediate the longitudinal edges 32 and 34 completes the construction of blank 30.

FIGS. 2 to 6 illustrate the folding of blank 30 to form box 10.

Figure 7:
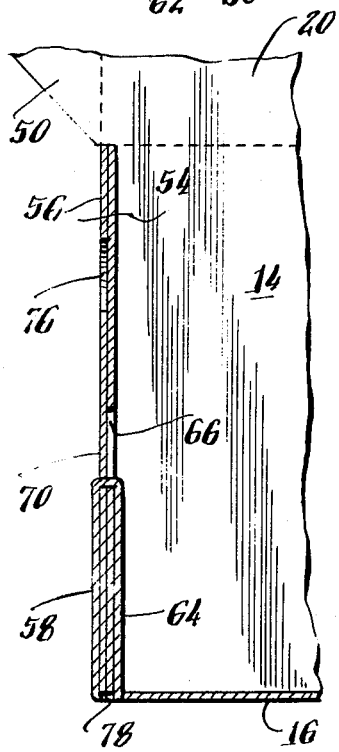
FIG. 7 is a cross-sectional view of the box construction of the invention taken substantially along the plane indicated by line 7—7 of FIG. 4.
Figure 5:
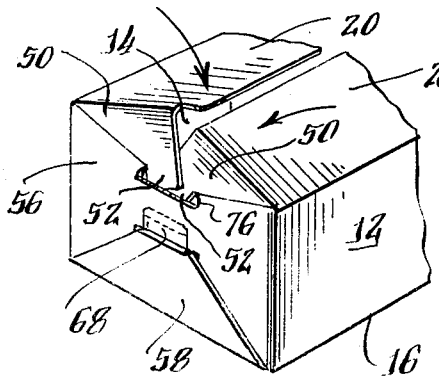

The side wall panels 12 and 14 are first folded 90° about the longitudinal edges 32 and 34, respectively, so that they assume a substantially upright position relative to the centrally located bottom panel 16. End panels 54 and 56 are then folded inwardly about transverse edges 44 and 42, respectively, and overlapped, with end panel 56 assuming the outermost position relative to end panel 54. The end panels 54 and 56 are then locked together. When panels 54 and 56 are overlapped, openings 66 and 68 are placed in registration. Die cut tab 70 may be slightly pushed through bell-shaped opening 66 to expose the bottom horizontal end slot portions of registered bell-shaped openings 66 and 68. The third or trapezoidal end panel 58 is then bent 90° about transverse edge 36 and 38, respectively, at the opposite sides of bottom panel 16, and tab 64 bent about foldlines 60 and 62, and inserted through the bottom slot portion of the registered bell-shaped openings 66 and 68 in panels 54 and 56, respectively. The tabs 64 are then bent 180° downwardly along the interior surface of end panel 54. The distal end of tab 64 is inserted within opening 78 formed in the bottom panel 16 to lock tab 64 in place and securely fix the three-ply end wall (see FIG. 7).

Figure 3:
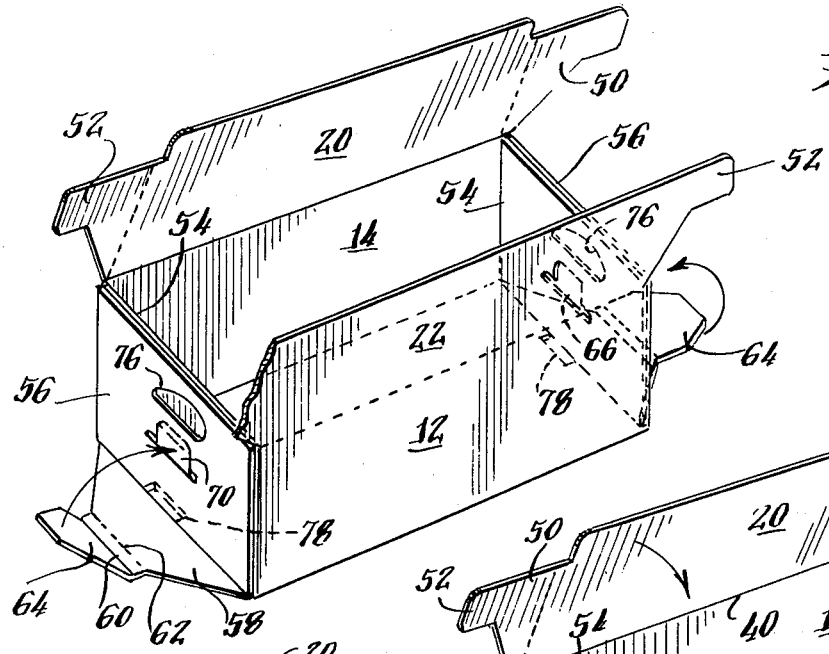
Figure 4:
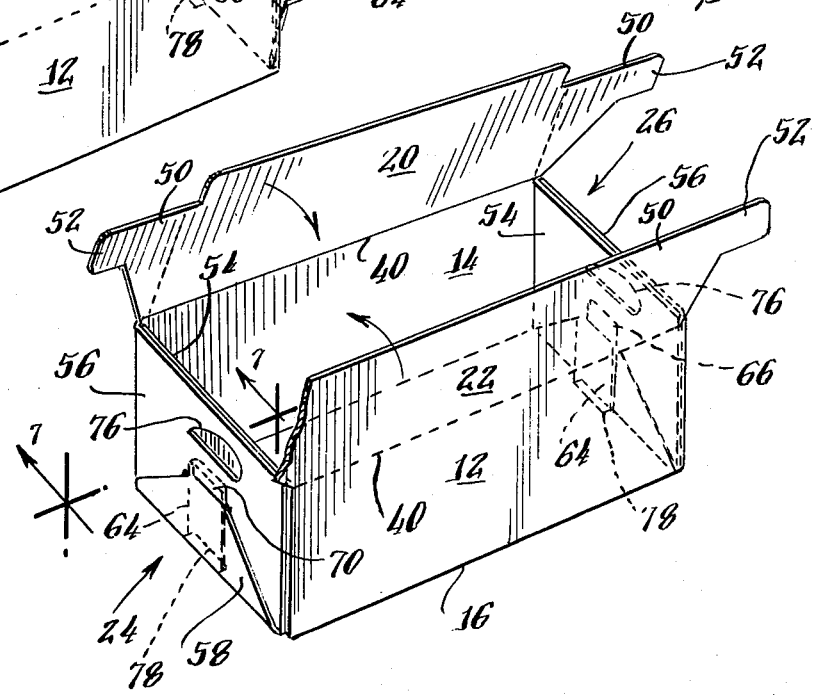

With the box 10 in the position shown in FIG. 4, that is, uncovered, files may be position within the interior of box 10. Top panels 22 and 20 are then folded about longitudinal edges 40, 180° relative to side wall panels 12 and 14, respectively, to overlie the interior of box 10. Panel 20, being greater in width than panel 22 is folded last so that the extended portion of panel 20 overlies a portion of panel 22 to form a complete cover for box 10. Tabs 50 are then folded 90° about transverse edges 48 and 46, respectively, at the top and bottom or opposite sides of the panels 20 and the tongues 52 on each tab are inserted through an adjacent half-moon opening 76 in the exposed portion of end panel 56 between overlapping panels 54 and 56 of each end wall 24, 26 to lock the top panels 20 and 22 in closing relation on top of box 10.

Die-cut tab 70 may then be completely pushed through registered openings 66 and 68 and pivoted 180° about foldlines 72 and 74 to abut the inner surface of end panel 54 to clamp tabs 50 between the end panels. The holes formed by registered openings 66 and 68 in the end panels 54 and 56 may be utilized as hand holes to lift and move box 10. Since end walls 18 and 20 are formed from three-plies, box 10 is reinforced so that the weight of the material disposed within box 10 will not cause the end walls to sag when they are carried.

While the invention has been disclosed as particularly useful for the storage of files, paper, and the like, it should be understood that the reinforced box of the invention can be used for the shipment of produce, meats or for the dispensing of retail products, as well; the particular use of the box constituting no limitation as to the scope of the appended claims. It should also be understood that each of the edges referred to on blank 30 can be scored to facilitate bending.

What is claimed as new is:

1. A one-piece storage box comprising:

a bottom wall having a first and second pair of opposed, parallel edges, a side wall connected to each of the first pair of opposed edges of said bottom wall, an end wall connected to each of the second pair of opposed edges of said bottom wall, each of said end walls including a pair of overlapping end panels, each of said overlapping end panels being connected to an edge of one of said side walls and a third end panel connected to one of said second pair of opposed edges of said bottom wall overlapping said pair of end panels, said end panels having means therebetween for locking said panels together, said locking means including a pair of registered openings in said pair of overlapping end panels, a bendable tab on said third end panel received through said registered openings and said pair of overlapping end panels and bent downwardly within the interior of said box, and a tab on the outermost one of said pair of overlapping end panels of each end wall hinged to an edge of the registered opening in said one overlapping end panel, said tab received through the other one of said registered openings in said other one of said pair of overlapping end panels and bent relative thereto, a top flap for forming a top wall for said storage box connected to an edge of each of said side walls, the outermost one of said pair of overlapping end panels of each end wall including an opening other than said registered opening therethrough, and each of said top flaps including a bendable tab extension extending from opposite ends thereof received within said other opening in each of said outermost ones of said pair of overlapping end panels of each end wall.

2. The storage box of claim 1 wherein said bottom wall includes an opening for receiving the tab inserted through the registered openings in said pair of overlapping end panels in each end wall.

3. The storage box of claim 1 wherein one of said top flaps is wider than the other so as to cause said flaps to overlap to form said top wall.

4. A one-piece, planar, paperboard blank for forming the box of claim 1.

5. A one-piece, planar, paperboard blank for forming the box of claim 2.

6. A one-piece, planar, paperboard blank for forming the box of claim 3.

7. A one-piece blank for forming a storage box comprising a central substantially rectangular panel having opposed longitudinal and transverse edges, a substantially rectangular side panel foldably connected to each of the longitudinal edges of said central panel, each of said side panels having opposed longitudinal and transverse edges, a substantially rectangular first and second panel foldably connected to opposed transverse edges of each of said side panels, each of the first and second panels including complementally shaped openings, a substantially trapezoidal panel foldably connected to each of the transverse edges of said central panel, an elongated tab foldably connected to the shorter parallel edge of each trapezoidal panel, a substantially rectangular panel approximately half the width of said central panel foldably connected to a longitudinal edge of each of said side panels, said half width panel having opposed longitudinal and transverse edges, an elongated tab foldably connected to each transverse edge of each of said half width panels, one of said first and one of said second panels connected to opposed transverse edges of one of said side panels having a second opening cut therein, and a tab hinged to an edge of one of said complementary shaped openings on one of said first and second panels connected to the opposed transverse edges of each of said side panels.

8. The blank of claim 7 wherein one of said half width panels is wider than the other.

9. The blank of claim 7 wherein an opening is cut in said central panel adjacent each transverse edge thereof.

* * * * *